US007524438B2

(12) United States Patent
Malalel et al.

(10) Patent No.: US 7,524,438 B2
(45) **Date of Patent: *Apr. 28, 2009**

(54) UNSATURATED POLYESTER-BASED MATERIAL FOR NEUTRON-SHIELDING AND FOR MAINTAINING SUB-CRITICALITY

(75) Inventors: Pierre Malalel, St Medard en Jalles (FR); Martine Valiere, Puteaux (FR)

(73) Assignee: Cogema Logistics, Montigny-le-Bretonneux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/490,714

(22) PCT Filed: Sep. 27, 2002

(86) PCT No.: PCT/FR02/03307

§ 371 (c)(1), (2), (4) Date: Mar. 25, 2004

(87) PCT Pub. No.: WO03/030183

PCT Pub. Date: Apr. 10, 2003

(65) Prior Publication Data

US 2005/0001205 A1 Jan. 6, 2005

(30) Foreign Application Priority Data

Oct. 1, 2001 (FR) ..... 01 12592

(51) Int. Cl.
*G21F 7/06* (2006.01)
*G21F 1/10* (2006.01)
*G21F 1/00* (2006.01)

(52) U.S. Cl. ..... 252/478; 523/136; 250/505.1; 250/515; 250/518.1; 376/272

(58) Field of Classification Search ..... 252/478
See application file for complete search history.

(56) References Cited

U.S. PATENT DOCUMENTS 2,796,411 A * 6/1957 Zirkle et al. ..... 250/518.1
2,961,415 A 11/1960 Axelrad
3,133,887 A 5/1964 Alliegro
3,261,800 A * 7/1966 Collins, III ..... 523/136

(Continued)

FOREIGN PATENT DOCUMENTS

DE 199 55 192 A1 5/2001

(Continued)

OTHER PUBLICATIONS

Derwent abstract ACC-No. 1985-008236 for FR 2546331A.*

(Continued)

*Primary Examiner*—Joseph D Anthony
(74) *Attorney, Agent, or Firm*—Christensen O'Connor Johnson Kindness PLLC

(57) ABSTRACT

The invention concerns a neutron shielding material for maintaining sub-criticality based on unsaturated polymer: Said material comprises an unsaturated polyester resin, at least an inorganic boron compound, and at least a hydrogenated inorganic compound, in amounts such that the boron concentration is $4.10^{21}$ to $25.10^{21}$ atoms per $cm^3$ and the hydrogen concentration is $3.10^{22}$ to $5.5.10^{22}$ atoms per $cm^3$.

15 Claims, 1 Drawing Sheet

U.S. PATENT DOCUMENTS

| | | | | |
|---|---|---|---|---|
| 3,361,684 | A * | 1/1968 | Chvatal | 252/478 |
| 3,609,372 | A * | 9/1971 | Vogel | 250/518.1 |
| 3,829,532 | A * | 8/1974 | Meloy et al. | 523/508 |
| 3,879,318 | A * | 4/1975 | Forsyth | 523/508 |
| 4,134,937 | A * | 1/1979 | Cass et al. | 523/136 |
| 6,548,570 | B1 | 4/2003 | Lange | |
| 6,605,817 | B1 * | 8/2003 | Nihei et al. | 250/518.1 |
| 6,797,972 | B2 * | 9/2004 | Kamoshida et al. | 250/507.1 |
| 2004/0127599 | A1 * | 7/2004 | Abadie et al. | 523/136 |
| 2005/0012054 | A1 * | 1/2005 | Valiere | 250/505.1 |

FOREIGN PATENT DOCUMENTS

| | | | |
|---|---|---|---|
| EP | 0 108 622 | A2 | 5/1984 |
| EP | 0 119 781 | A1 | 9/1984 |
| EP | 0 372 758 | A1 | 6/1990 |
| EP | 0 628 968 | A1 | 12/1994 |
| FR | 2 092 848 | A | 1/1972 |
| FR | 2 505 080 | A1 | 11/1982 |
| FR | 2 546 331 | A1 | 11/1984 |
| FR | 2546331 | A1 * | 11/1984 |
| GB | 859696 | A | 6/1959 |
| GB | 1 049 890 | A | 12/1963 |
| JP | 55 119099 | A | 9/1980 |
| JP | 59-126296 | A | 7/1984 |
| JP | 60-065032 | A | 4/1985 |
| WO | 95/28440 | A1 | 10/1995 |

OTHER PUBLICATIONS

Derwent abstract ACC-No. 1982-07463J for FR 2505080A.*
Derwent abstract ACC-No. 1972-26159T for FR 2092848A.*
"Encyclopedia of Poymner Science and Engineering," (1989, John Wiley & Sons, Inc., New York), pp. 425-441.*
USPTO obtained translation of FR 2546331A1.*
USPTO obtained translation of JP 55-119099 (Sep. 1980), Ozawa et al.*
"Hawley's Condensed Chemical Dictionary," Fourteenth Edition (John Wiley & Sons, Inc, New York, 2001), pp. 39, 155-157, 688, 753, 1192, "alumina trihydrate," "boric acid," "boric oxide," "boron carbide," "boron nitride," "magnesium hydroxide," "mineral," "zinc borate."*

* cited by examiner

UNSATURATED POLYESTER-BASED MATERIAL FOR NEUTRON-SHIELDING AND FOR MAINTAINING SUB-CRITICALITY

TECHNICAL FIELD

The present invention relates to a material for neutron-shielding and for maintaining sub-criticality. Such materials are useful in nuclear energy for protecting the operatives against the neutron radiation emitted by radioactive products and for preventing runaway of the neutron-forming chain reaction, more particular when these products contain fissile materials.

They may be used in particular as neutron screens in packagings for transportation and/or storage of radioactive products, for example nuclear fuel assemblies.

For neutron shielding, it is necessary to slow down the neutrons and thus to use highly hydrogenated materials, incorporating therein a boron compound to ensure uptake of the neutrons.

To maintain sub-criticality, it is necessary to have a high content of neutron absorber in order to prevent runaway of the neutron-forming chain reaction.

Furthermore, it is necessary for these materials to be self-extinguishable.

PRIOR ART

Neutron-shielding materials obtained from a mixture of a high-density mineral material and a thermosetting resin have been described in EP-A-0 628 968 [1]. In this document, the thermosetting resin may be an unsaturated polyester resin and the mineral fillers may be heavy metals or compounds thereof. Thus, this document does not envisage the addition of boron compounds. The preferred thermosetting resin is an epoxy resin.

Document GB-A-1 049 890 [2] describes neutron-absorbing coatings or moulded articles comprising at least 0.3% by weight of boron, obtained from a copolymerizable blend of an unsaturated polyester and of an unsaturated monomer in which either the acidic component of the polyester is partially derived from boric acid, or the polymerizable monomer is partially a boric acid ester. Preferably, the boron content is from 0.3% to 5% by weight. This boron content remains insufficient to efficiently ensure the absorption of neutrons. Moreover, this material is not self-extinguishable.

Document JP-A-55 119099 [3] describes materials for protecting against neutrons. Such a material has a hydrogen atom density of $6.1\times10^{22}$ hydrogen atoms per $cm^3$, but does not comprise a neutron absorber. Thus, it cannot ensure maintenance of the sub-criticality of a nuclear fuel transportation packaging.

DESCRIPTION OF THE INVENTION

A subject of the present invention is, specifically, a neutron-shielding material which allows maintaining sub-criticality by means of the presence of a boron compound in sufficient amount.

According to the invention, the material for neutron-shielding and for maintaining sub-criticality comprises an unsaturated polyester resin, at least one boron mineral compound and at least one hydrogenated mineral compound in amounts such that the boron concentration is from $4\times10^{21}$ to $25\times10^{21}$ and preferably from $9\times10^{21}$ to $15\times10^{21}$ atoms per $cm^3$ and the hydrogen concentration is from $3\times10^{22}$ to $5.5\times10^{22}$ and preferably from $4\times10^{22}$ to $5\times10^{22}$ atoms per $cm^3$.

According to the invention, the unsaturated polyester resin may be of various types. In general, resins obtained by polycondensation of one or more diacids with one or more glycols are used, at least one of the constituents containing an ethylenic double bond capable of subsequently reacting with a vinyl, acrylic or allylic compound.

Examples of such resins that may be mentioned include the following polyesters:

- the resin NORSODYNE® M0070C sold by CRAY VALLEY™ Total Resins Division, which is a resin based on a maleic acid and propylene glycol, crosslinked with styrene;
- unsaturated polyester resins based on isophthalic or orthophthalic acid and neopentyl glycol, such as CRYSTIC® from SCOTT BADER™; and
- unsaturated polyester resins based on bisphenol A and fumaric acid units, for instance the ATLAC™ brand resins sold by DSM™.

It is also possible to use the resins obtained from common polyols such as propylene glycol, dipropylene glycol, diethylene glycol and oxyethylated or oxypropylated polyols such as oxyethylenated ethylene glycol and unsaturated diacids such as maleic anhydride, citraconic acid, metaconic acid and itaconic acid, or saturated diacids such as phthalic anhydride and its chlorinated or brominated derivatives.

In the material of the invention, these resins have been converted into a thermoset material by reaction with a copolymerization monomer such as styrene and styrene derivatives, for instance methylstyrene and divinylbenzene.

According to the invention, the boron mineral compound and the hydrogenated mineral compound and the amounts thereof are chosen so as to obtain boron and hydrogen concentrations that are within the ranges indicated above.

The boron compounds that may be used belong to the group comprising boric acid $H_3BO_3$, colemanite $Ca_2O_{14}B_6H_{10}$, zinc borates $Zn_2O_{14.5}H_7B_6$, $Zn_4O_8B_2H_2$ and $Zn_2O_{11}B_6$, boron carbide $B_4C$, boron nitride BN and boron oxide $B_2O_3$.

Preferably, the composite material of the invention comprises two boron mineral compounds, one of which is hydrogenated, for example zinc borate $Zn_2O_{14.5}H_7B_6$ or $Zn_4O_8B_2H_2$ or $Zn_2O_{11}B_6$, and boron carbide.

The hydrogenated mineral compounds that may be used preferably belong to the group of alumina hydrates and magnesium hydroxide. Alumina hydrate $Al(OH)_3$ is preferably used.

The material of the invention may also comprise poly(vinyl acetate) to give the material a shrink-proof nature.

It may also comprise a hydrogenated organic filler such as melamine, to improve its self-extinguishability properties.

In the material of the invention, the amounts of the various constituents are also chosen so as to obtain density, self-extinguishability and thermal conductivity properties that are suitable for use in a packaging for transporting and/or storing radioactive material.

In particular, it is necessary to have good ageing properties, at a relatively high temperature, since the products placed in the packaging can reach a temperature of 150° C.

It is also necessary for the material to be fire-resistant, which assumes that it is self-extinguishable, i.e. the fire stops when the flame is put out; it therefore does not feed the fire.

According to the invention, this self-extinguishability property is imparted in particular by the presence of hydrogen-containing and/or boron-containing mineral compounds, for example alumina hydrate or zinc borate. The self-extinguishability nature may also be imparted by the presence of melamine.

Similarly, the material should have a thermal conductivity that is low but sufficient to remove heat from the transported elements such as irradiated fuel elements.

Finally, as will be seen later, given that this material is obtained by casting a mixture of the various constituents and of a vinyl diluent, it is important for the amounts of the various constituents to be such that the mixture has the property of being able to be cast.

By way of example of a composition of material in accordance with the invention, mention may be made of the material comprising 25% to 40% by weight of thermoset unsaturated polyester resin, i.e. including the vinyl diluent, for example styrene.

Preferably, according to the invention, the material has a density of greater than or equal to 1.7, for example from 1.7 to 1.85.

In order to obtain good properties of maintenance of sub-criticality, the boron content is preferably at least $9.4\times10^{21}$ boron atoms per $cm^3$.

The material of the invention may be prepared by curing a mixture of the constituents in the unsaturated polyester resin in solution in a vinyl diluent.

Thus, a subject of the invention is also a process for preparing the neutron-shielding material described above, which consists in preparing a mixture of the unsaturated polyester resin in solution in a vinyl diluent with the boron mineral compound(s) and the hydrogenated mineral compound(s), adding to the mixture a catalyst and a curing accelerator, casting the mixture in a mould and leaving it to cure in the mould.

The vinyl diluent may be, for example, styrene, vinyltoluene, divinylbenzene, methylstyrene, methyl acrylate, methyl methacrylate or an allylic derivative such as diallyl phthalate. Preferably, styrene is used, which makes it possible both to dissolve the unsaturated polyester resin and to cure it by copolymerization.

The catalysts and curing accelerators used are chosen from the compounds usually used for curing unsaturated polyesters.

The catalysts may be, in particular, organic peroxides, for example:

- ketone-based peroxides, for instance methyl ethyl ketone peroxide, acetylacetone peroxide, methyl isobutyl ketone peroxide and cyclohexanone peroxide;
- diacyl peroxides, for example benzoyl peroxide optionally in combination with aromatic tertiary amines such as dimethylaniline, diethylaniline and dimethyl-para-toluidine; and
- dialkyl peroxides such as dicumyl peroxide and di-tert-butyl peroxide.

The accelerators most commonly used are divalent cobalt salts, for instance cobalt naphthenate or octoate, and aromatic tertiary amines such as diemthylaniline, dimethyl-para-toluidine and diethylaniline.

One or more additives such as crosslinking inhibitors, surfactants and shrink-proofing agents may also be added to the mixture.

According to the invention, the mould used for curing the resin may consist directly of the packaging for transporting and/or storing radioactive products. By way of example, the packaging may comprise two concentric walls, for example two steel ferrules, between which the mixture is cast before curing. The packaging may also comprise peripheral housings into which the mixture is cast.

Other characteristics and advantages of the invention will emerge more clearly on reading the description that follows, of examples of embodiments given, of course, for illustrative purposes and in a non-limiting manner, with reference to the attached drawings.

DETAILED DESCRIPTION OF THE EMBODIMENTS

Figure 1:
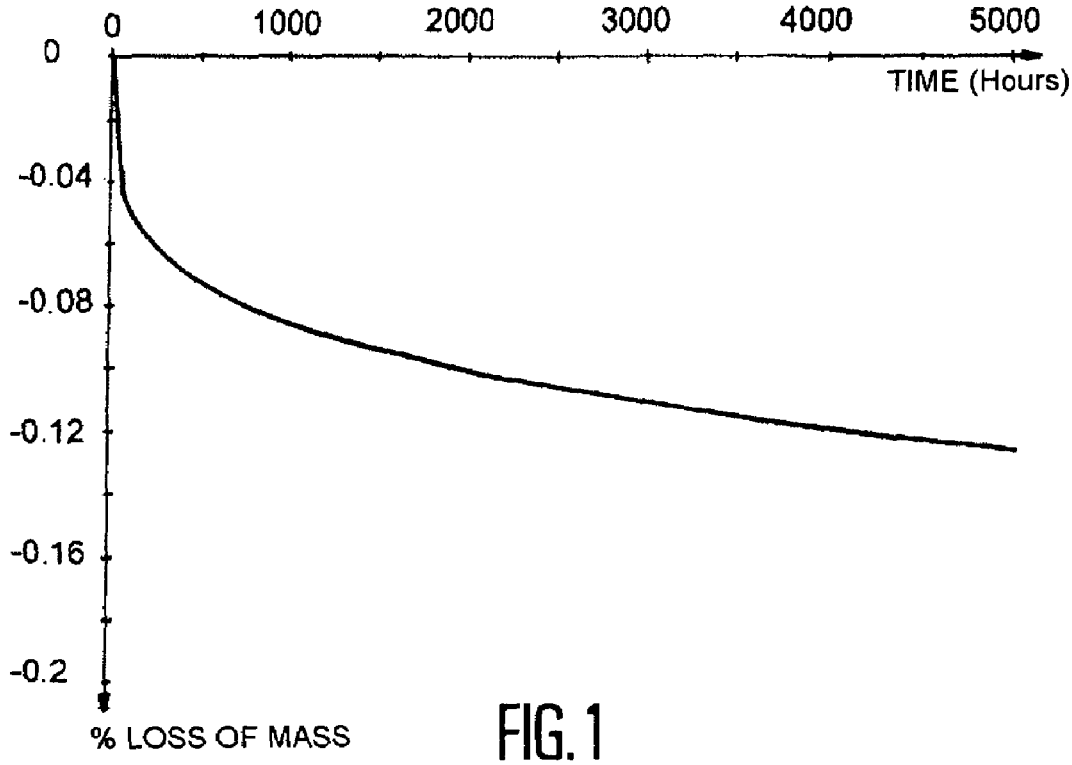
FIG. 1 shows the loss of mass (in %) at 50° C. of a material in accordance with the invention, as a function of time (in hours).

The examples that follow illustrate the manufacture of composite materials for neutron-shielding and for maintaining sub-criticality, charged with boron carbide, using, as unsaturated polyester resin, the resin sold by CRAY VALLEY™ under the name NORSODYNE® M0070C.

EXAMPLE 1

A polymerization mixture is prepared from the unsaturated polyester resin NORSODYNE™ M0070C, which is in solution in styrene, poly(vinyl acetate) PVAC, zinc borate $Zn_2O_{14.5}H_7B_6$, colemanite, boron carbide and alumina hydrate, using proportions given in Table 1. The following constituents are added to the mixture:

- 0.85 g/kg of mixture of the accelerator NL 51P sold by AKZO NOBEL™,
- 0.60 g/kg of mixture of the inhibitor TC 510 sold by the ARNAUD™ group,
- 0.30 g/kg of mixture of the amine NL 63-10 sold by AKZO NOBEL™,
- 9.3 g/kg of mixture of the surfactant BYK W980 sold by BYK CHEMIE™, and
- 8.5 g/kg of mixture of the catalyst BUTANOX® M50 (methyl ethyl ketone peroxide).

The resin is then cured. To do this, it is necessary to preheat the mixture to 45° C. The mixture is then degassed under vacuum for 4 minutes, after which it is cast into a mould heated to 100° C. and placed under a negative pressure (−0.3 bar) in order to facilitate the filling and to reduce the casting time.

In this example, the mould consists of a packaging for transporting nuclear fuels, comprising:

an outer ferrule made of stainless steel sheet,
an inner ferrule made of stainless steel sheet, and
a flat base made of stainless steel sheet.

The space between the two concentric ferrules, which is at least 18 mm thick, is intended for casting the polymerizable mixture. This space, closed at its top end, comprises on this end two diametrically opposite holes. One of the holes is connected to an addition funnel and the other hole is connected to a vacuum pump to create a negative pressure of −0.3 bar during casting.

After filling, the mould is placed in an oven at 100° C. for 4 hours.

A composite material having the following properties is thus obtained:

density: 1.7,
hydrogen content: 3.9% by weight, i.e. $4\times10^{22}$ atoms/$cm^3$,
boron content: 9.9% by weight, i.e. $9.4\times10^{21}$ atoms/$cm^3$.

EXAMPLE 2

The same procedure as in Example 1 is followed, using the constituents and proportions given in Table 1.

The mixture also comprises:

0.7% of the weight of resin + styrene, of the accelerator NL 49P sold by AKZO NOBEL™, and 1.8% of the weight of resin + styrene, of the catalyst CYCLONOX LR™ (cyclohexanone peroxide) sold by AKZO NOBEL™.

TABLE 1

| Constituents | Example 1 (% by weight) | Example 2 (% by weight) | Example 3 (% by weight) |
|---|---|---|---|
| Unsaturated polyester M0070C | 29 | 32.7 | 27 |
| Added Styrene | | 4.75 | 5 |
| Zinc borate | 23 | 33.6 | 13 |
| Colemanite $Ca_2O_{14}B_6H_{10}$ | 27.7 | | |
| Boron carbide $B_4C$ | 4.3 | 6.55 | 15 |
| Alumina hydrate $Al(OH)_3$ | 7 | 22.4 | 40 |
| PVAC | 9 | | |

In this case, the curing is performed at room temperature and, after 20 to 30 minutes, a material having the following characteristics is obtained:

density: 1.77, hydrogen content: 3.9% by weight, i.e. $4.1\times10^{22}$ at/cm$^3$, boron content: 10.1% by weight, i.e. $10\times10^{21}$ at/cm$^3$.

The material obtained has satisfactory thermal properties.

Its glass transition temperature $T_g$, determined by TMA (METTLER™)with a temperature rise of 10° C./minute, is about 145° C.

The glass transition temperature has an appreciable influence on the thermomechanical behaviour since, above this temperature, the material has rubbery behaviour.

The measurement of the coefficient of expansion, measured by TMA (METTLER™) with a temperature rise of 10° C./minute, gives for the material:

before the $T_g$ temperature: $51.2\times10^{-6}$ K$^{-1}$ , and after the $T_g$ temperature: $93.3\times10^{-6}$ K$^{-1}$ , The specific heat is measured by differential thermal analysis (DSC30, METTLER™), with a rate of temperature rise of 10° C./minute, over a temperature range from 25° C. to 200° C. The results obtained are given in Table 2.

TABLE 2

| Specific heat as a function of the temperature | |
|---|---|
| Temperature (° C.) | Cp (J.g$^{-1}$ · ° C.$^{-1}$) |
| 30 | 0.0269 |
| 40 | 1.07 |
| 50 | 1.13 |
| 60 | 1.17 |
| 70 | 1.23 |
| 80 | 1.28 |
| 90 | 1.33 |
| 100 | 1.38 |
| 110 | 1.42 |
| 120 | 1.46 |
| 130 | 1.50 |
| 140 | 1.53 |
| 150 | 1.57 |
| 160 | 1.60 |
| 170 | 1.64 |
| 180 | 1.67 |
| 190 | 1.69 |
| 200 | 1.71 |

Thermal conductivity measurements are also taken for temperatures of between 20° C. and 185° C. Over this temperature range, the thermal conductivity value of the resin is in the region of 0.55 W/m.K. The values obtained are given in Table 3.

TABLE 3

| Conductivities at various temperatures | |
|---|---|
| Temperature (° C.) | λ(W/m · K) |
| 25 | 0.531 |
| 30 | 0.540 |
| 50 | 0.564 |
| 75 | 0.590 |
| 100 | 0.623 |
| 125 | 0.641 |
| 150 | 0.646 |
| 170 | 0.632 |
| 185 | 0.629 |

The mechanical properties of the material are also determined by performing compression tests at temperatures of −40, +23 and +150° C. The modulus of compression of the material may thus be determined, and the results obtained are given in Table 4.

TABLE 4

| | Modulus of compression in MPa | |
|---|---|---|
| Temperature in ° C. | Free | In conformator |
| −40 | 4693 ± 30.7 | 3973 ± 127 |
| 23 | 5260 ± 187 | 5333 ± 165 |
| 150 | 1855 ± 321 | 3360 ± 81 |

Tests of thermal ageing of the material at 50° C. and at 150° C. are also performed.

The tests of ageing at 50° C. over 6 months consist in placing samples of the material 25×36×100 mm in size in an oven at 50° C. and in monitoring the loss of mass of these samples over time. The curve of the change in the loss of mass of the material (in %) as a function of time (in hours) is shown in FIG. 1.

Thermal ageing tests at 150° C. are also performed, the samples being identical in size.

Figure 2:
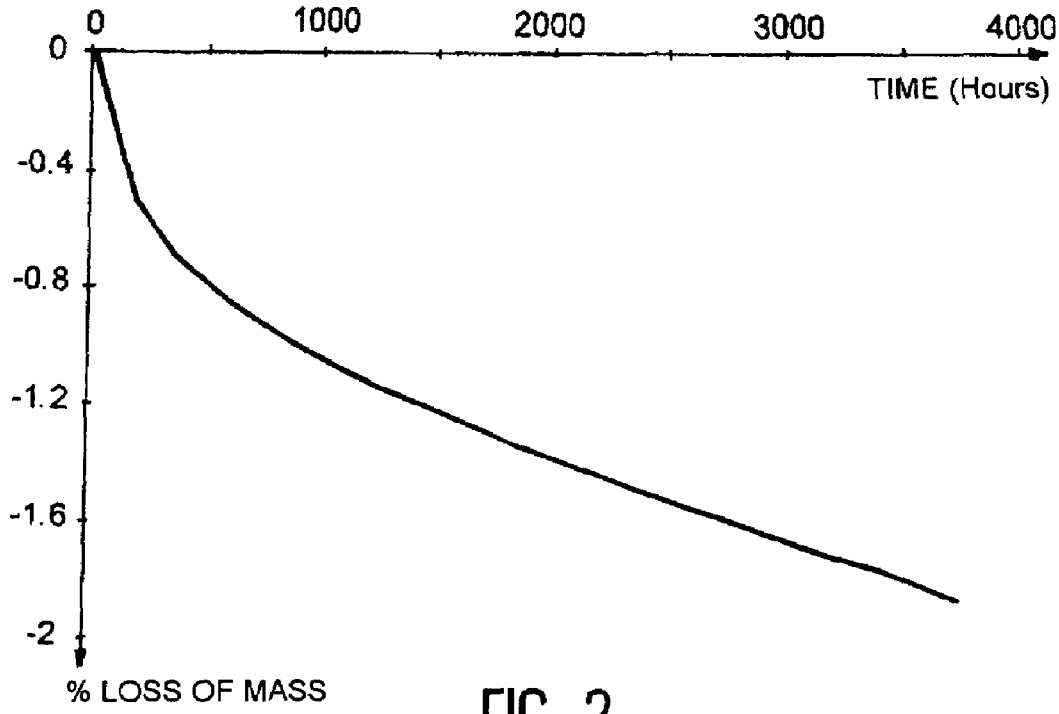
FIG. 2 shows the loss of mass (in %) at 150° C. of a material in accordance with the invention, as a function of time (in hours).

FIG. 2 shows the loss of mass (in %) of this material, at 150° C., as a function of time (in hours).

Tests of fire resistance of this material were also performed on samples 400×300×20 mm in size. For this test, the material is rated "M1", which is very satisfactory.

A fire test of half an hour at 800° C. was also performed on two blocks 240 mm in diameter and 60 mm in height. For the first block, the flame was directly in contact with the material, whereas the second block was protected with a stainless steel sheet 1 mm thick.

For the first test, the self-extinguishability of the resin is immediate after removal of the torch. Furthermore, the thickness of carbonized material is 9 mm.

For the second test, the thickness of carbonized material is 2 mm.

EXAMPLE 3

The same procedure as in Example 1 is followed in order to prepare a material for neutron-screening and for maintaining sub-criticality, using the constituents and proportions given in Table 1 and recalled hereinbelow:

unsaturated polyester M0070C: 27% by weight added styrene: 5% by weight zinc borate: 13% by weight boron carbide $B_4C$: 15% by weight alumina hydrate $Al(OH)_3$: 40% by weight The mixture also comprises:

0.7% of the weight of resin+styrene of the accelerator NL 49 P sold by AKZO NOBEL™, 1.8% of the weight of resin+styrene of the catalyst CYCLONOX LR™ (cyclohexanone peroxide) sold by AKZO NOBEL™, and 9.3 g/kg of mixture of the surfactant BYK W980 sold by BYK CHEMIE™.

A material having the following characteristics is obtained:

density: 1.83 hydrogen content: 3.9% by weight, i.e. $4.1\times10^{22}$ at/cm$^3$ boron content: 13.7% by weight, i.e. $13.3\times10^{21}$ at/cm$^3$.

Thus, the material of the invention has properties that are very advantageous for neutron shielding and for maintaining sub-criticality during the transportation of irradiated nuclear fuel assemblies.

CITED REFERENCES

[1] EP-A-0 628 968

[2] GB-A-1 049 890

[3] JP-A-55 119099

The invention claimed is:

1. Material for neutron-shielding and for maintaining sub-criticality, comprising:

(a) a thermoset unsaturated polyester resin;

(b) at least two inorganic boron compounds including zinc borate and boron carbide; and (c) at least one inorganic hydrogenated compound selected from the group of alumina hydrates and magnesium hydroxide, wherein the boron concentration in the material is from $9\times10^{21}$ to $25\times10^{21}$ atoms per cm$^3$ and the hydrogen concentration in the material is from $4\times10^{22}$ to $5\times10^{22}$ atoms per cm$^3$, wherein the material is a cured material.

2. Material according to claim 1, in which the at least one inorganic hydrogenated compound is an alumina hydrate.

3. Material according to claim 1, also comprising poly (vinyl acetate).

4. Material according to claim 1, also comprising a hydrogenated organic filler to improve the self-extinguishability properties of the material.

5. Material according to claim 1, comprising 25% to 40% by weight of thermoset unsaturated polyester resin.

6. Material according to claim 1, which has a density of greater than or equal to 1.7.

7. Material according to claim 1, which comprises at least $9.4\times10^{21}$ boron atoms per cm$^3$.

8. Process for preparing a material according to claim 1, which consists of:

(a) preparing a mixture of the unsaturated polyester resin in solution in a vinyl diluent with the inorganic boron compounds and the inorganic hydrogenated compound(s);

(b) adding to the mixture a catalyst and a curing accelerator;

(c) casting the mixture in a mould; and (d) leaving the mixture to cure in the mould.

9. Process according to claim 8, in which the vinyl diluent is styrene.

10. Process according to claim 8, in which the mould is a packaging for transporting and/or storing radioactive products.

11. Packaging for transporting or storing radioactive products, comprising a neutron shield made of a material according to claim 1.

12. Material according to claim 1, which has a density of from 1.7 to 1.85.

13. Material for neutron-shielding and for maintaining sub-criticality, comprising:

(a) a thermoset unsaturated polyester resin;

(b) at least one inorganic boron compound; and (c) at least one inorganic hydrogenated compound selected from the group of alumina hydrates and magnesium hydroxide, wherein the boron concentration in the material is from $10\times10^{21}$ to $25\times10^{21}$ atoms per cm$^3$ and the hydrogen concentration in the material is from $3\times10^{22}$ to $5\times10^{22}$ atoms per cm$^3$, and wherein the material is a cured material.

14. Material for neutron-shielding and for maintaining sub-criticality, comprising:

(a) a thermoset unsaturated polyester resin and at least one hydrogenated mineral compound;

(b) a boron concentration in the material in the range of $13.3\times10^{21}$ to $25\times10^{21}$ atoms per cm$^3$; and (c) a hydrogen concentration in the material in the range of $3\times10^{22}$ to $5\times10^{22}$ atoms per cm$^3$; wherein the material is a cured material and wherein the material is self-extinguishable and has thermal resistance up to 150 degrees C.

15. Material for neutron-shielding and for maintaining sub-criticality, comprising:

(a) a thermoset unsaturated polyester resin;

(b) a boron concentration in the material in the range of $13.3\times10^{21}$ to $25\times10^{21}$ atoms per cm$^3$; and (c) at least one inorganic hydrogenated compound, wherein the hydrogen concentration in the material in the range of $3\times10^{22}$ to $5\times10^{22}$ atoms per cm$^3$, wherein the material is a cured material.

* * * * *

UNITED STATES PATENT AND TRADEMARK OFFICE

CERTIFICATE OF CORRECTION

PATENT NO. : 7,524,438 B2
APPLICATION NO. : 10/490714
DATED : April 28, 2009
INVENTOR(S) : P. Malalel et al.

It is certified that error appears in the above-identified patent and that said Letters Patent is hereby corrected as shown below:

| COLUMN | LINE | |
|---|---|---|
| 8 | 38 | ";" should read --,-- |
| (Claim 14, | line 8) | |

Signed and Sealed this

Sixth Day of October, 2009

David J. Kappos

David J. Kappos
*Director of the United States Patent and Trademark Office*